US005421774A

United States Patent [19]

Specht

[11] Patent Number: 5,421,774

[45] Date of Patent: Jun. 6, 1995

[54] EXHAUST VENT ADAPTER FOR USE WITH MULTIPLE HEATING UNITS

[75] Inventor: Werner Specht, Sharpsville, Pa.

[73] Assignee: Thomas & Betts Corporation, Memphis, Tenn.

[21] Appl. No.: 45,279

[22] Filed: Apr. 6, 1993

[51] Int. Cl.[6] ..... F23J 11/02

[52] U.S. Cl. ..... 454/45; 126/307 R

[58] Field of Search ..... 126/307 R, 307 A, 312, 126/85 B; 454/1, 45, 47, 345; 285/133.1

[56] References Cited

U.S. PATENT DOCUMENTS

| | | | |
|---|---|---|---|
| 1,484,328 | 2/1924 | Heimbach . | |
| 4,031,631 | 6/1977 | Robinson . | |
| 4,187,833 | 2/1980 | Zahora et al. | 126/312 |
| 4,319,125 | 3/1982 | Prince | 219/347 |
| 4,979,343 | 12/1990 | Baccelliere | 52/218 |

FOREIGN PATENT DOCUMENTS

| | | | |
|---|---|---|---|
| 2331754 | 6/1977 | France | 454/345 |
| 2748772 | 5/1974 | Germany | 454/345 |

*Primary Examiner*—Harold Joyce
*Attorney, Agent, or Firm*—Robert M. Rodrick

[57] ABSTRACT

An exhaust vent adapter is provided for use in a heating system having a plurality of heating units, which allows all heating units to discharge combustion gases through a single exhaust opening. The adapter comprises a body with a plurality of discrete chambers formed therein, each chamber communicating with a separate heating unit. The body of the adapter has a single exhaust opening formed therein, through which each chamber is independently connected to a separate exhaust vent pipe. The vent pipes leading from plurality of the chambers are concentrically arranged, and may be extended through a single opening in either the wall or ceiling of a building in which the heating units are installed. In a preferred embodiment, the body of the adapter has a single divider secured therein, which defines two chambers and segregates the combustion gases from a pair of heating units.

6 Claims, 2 Drawing Sheets

EXHAUST VENT ADAPTER FOR USE WITH MULTIPLE HEATING UNITS

FIELD OF THE INVENTION

This invention relates to exhaust venting systems for use with fossil fuel burning heating units and, more particularly, to an adapter for enabling multiple heating units to vent combustion gases through a single opening in the ceiling or wall of a building.

BACKGROUND OF THE INVENTION

Heating systems used in warehouses or similar large volume commercial settings typically include a series of tubular heating members suspended from the ceiling, with a heating unit comprising a gas-fired combustion chamber forcing hot air through the system to provide heat. One such heating system is shown in U.S. Pat. No. 4,319,125, issued Mar. 9, 1982, to Prince, which is incorporated herein by reference. In large buildings, it is sometimes necessary to install two or more heating units in order to adequately raise the temperature of the working environment to a comfortable level. In such applications, multiple units may be operated at different levels and on different time schedules depending upon the area to be warmed by each individual unit.

Typically, each individual heating unit in a multiple unit setting has its own exhaust vent through which combustion gases are allowed to vent to the outdoors. Heating units of this type may rely on natural draft ventilation, or may include a forced draft ventilation system wherein a fan is employed to improve air flow through the exhaust vent, thereby improving the effectiveness of the vent in removing unwanted combustion gases. Natural draft ventilation systems typically vent through the ceiling of the building, while forced draft systems may utilize either vertical vent pipes extending through the ceiling, or horizontal vent pipes extending through a wall.

The use of multiple heating units in a single building typically requires a separate exhaust vent for each unit, necessitating a plurality of holes through either the ceiling or walls. This is highly undesirable for a number of reasons, not the least of which is the expense involved in cutting multiple holes in the ceiling and/or walls of a building. Accordingly, a need has been recognized for a way to effectively vent exhaust gases from a plurality of heating units through a single opening.

Solutions to the problems associated with multiple vent openings have been attempted in connection with systems other than a radiant tube heater system as addressed herein. For example, U.S. Pat. Nos. 1,484,328, issued Feb. 19, 1924, to Heimbach, 4,187,833 issued Feb. 12, 1990, to Zahora, et al., and 4,979,343 to Baccelliere, each discloses a chimney or flue stack which provides a common exhaust pathway for multiple fuel fired units. None of the systems disclosed in these patents has been found acceptable for use with radiant tube heating systems, particularly when forced draft heating units are employed. With multiple forced draft heating units, it is necessary for each exhaust vent to have an independent flow path to allow effective operation of multiple units at different times and/or heating rates. Accordingly, a need has also been recognized for a multiple unit exhaust vent adapted for use with forced draft heating units.

BRIEF SUMMARY OF THE INVENTION

It is a principle object of the present invention to provide an exhaust vent adapter which allows multiple heating units to vent combustion gases through a single opening.

It is another object to provide such an exhaust vent adapter which is adapted for use with forced draft heating units.

A further object of this invention is to provide an adapter which is equally well-suited for venting through a single opening in either the ceiling or a wall of a building.

A still further object is to provide an exhaust adapter which maintains separate flow paths for the exhausted gases being vented from a pair of heating units.

An additional object of this invention is to provide such an exhaust vent adapter which allows independent operation of each heating unit, and is adapted to accommodate units operating at different fuel burning rates.

In order to achieve these and other objects, the preferred embodiment of the present invention comprises a box-like housing having four generally rectangular walls bounded by a top and a bottom, with first and second inlets disposed in a pair of opposing walls. An exhaust opening is formed in the top of the housing, communicating directly with one of two discrete chambers formed within the housing, such chamber further communicating with one of the inlets. The second inlet communicates with a second chamber, which is separated from the first chamber by an internal divider. An internal pipe extends through the divider into the second chamber, to vent gases through the same exhaust opening formed in the top of the housing. The exhaust outlets for the first and second chambers are concentrically arranged, and extend through a single opening in either the wall or ceiling of the building to vent combustion gases to the outdoors.

DETAILED DESCRIPTION OF THE PREFERRED EMBODIMENT

Figure 1:
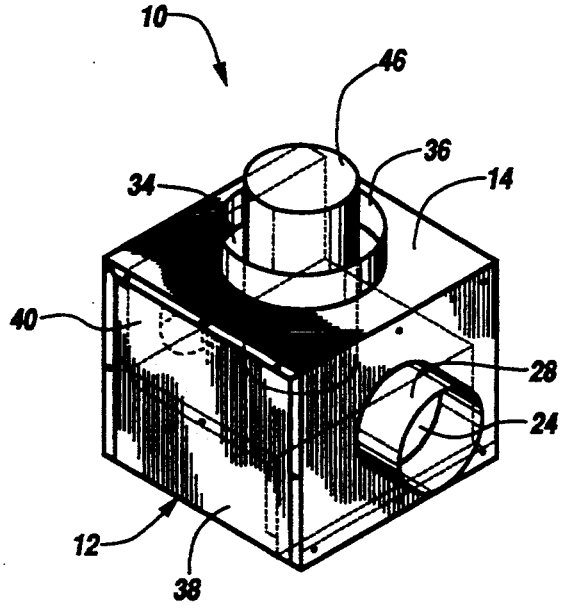
FIG. 1 is a top perspective view of the preferred embodiment of the exhaust vent adapter of this invention.
Figure 2:
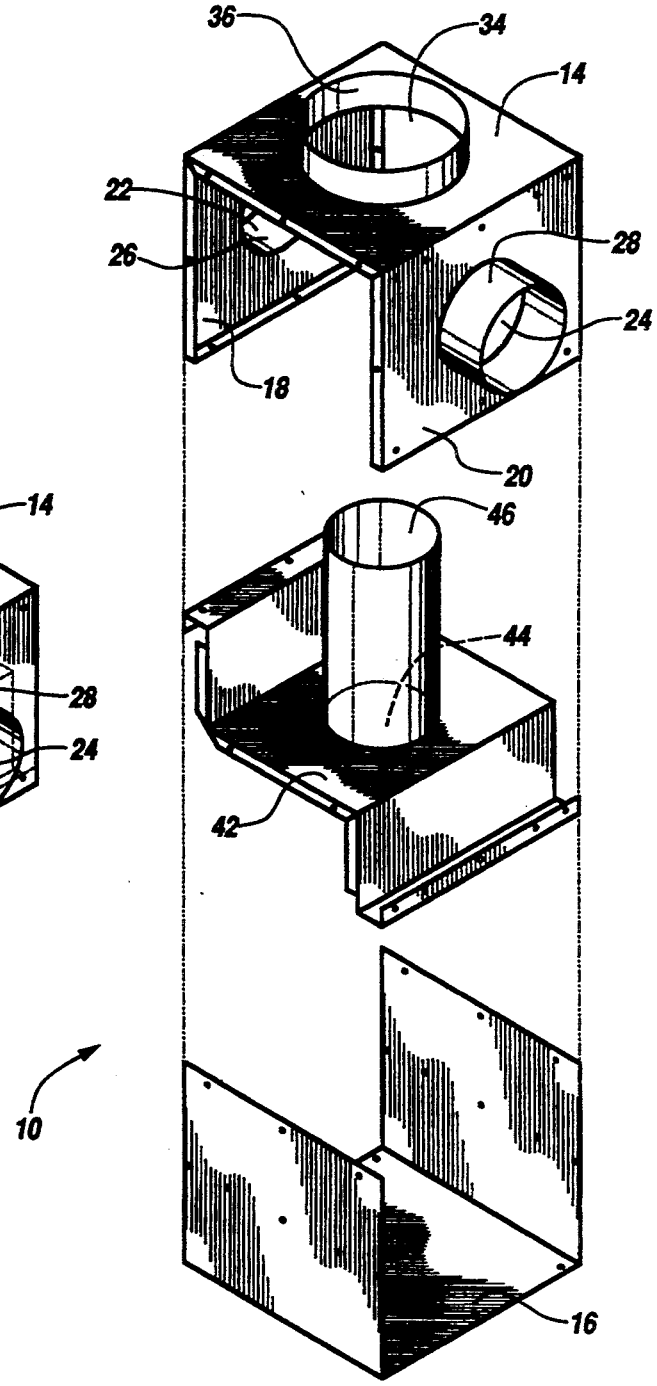
FIG. 2 is a top perspective exploded view of the adapter shown in FIG. 1.

Referring initially to FIGS. 1 and 2, the preferred embodiment of exhaust vent adapter 10 is shown having a body which comprises a housing 12 made up of four generally rectangular sides, and top 14 and bottom 16. Sides 18 and 20 have exhaust inlets 22 and 24 formed therein, respectively. Sides 18 and 20 have pipe sections 26 and 28 secured thereto annularly about inlets 22 and 24, whereby adapter 10 may be operatively secured to heating units 30 and 32 as shown schematically in FIG. 3.

Top 14 of housing 12 has an exhaust outlet 34 formed therethrough, with pipe 36 secured to top 14 annularly about outlet 34. The interior of housing 12 is divided into two discrete chambers 38 and 40 by means of internal divider 42. As best shown in FIG. 2, the central section of divider 42 has an exhaust outlet 44 formed therein with pipe 46 secured annularly about outlet 44 and extending therefrom. When assembled as shown, chamber 38 communicates with both inlet 22 and outlet 44, while chamber 40 communicates with both inlet 24 and outlet 34.

Figure 3:
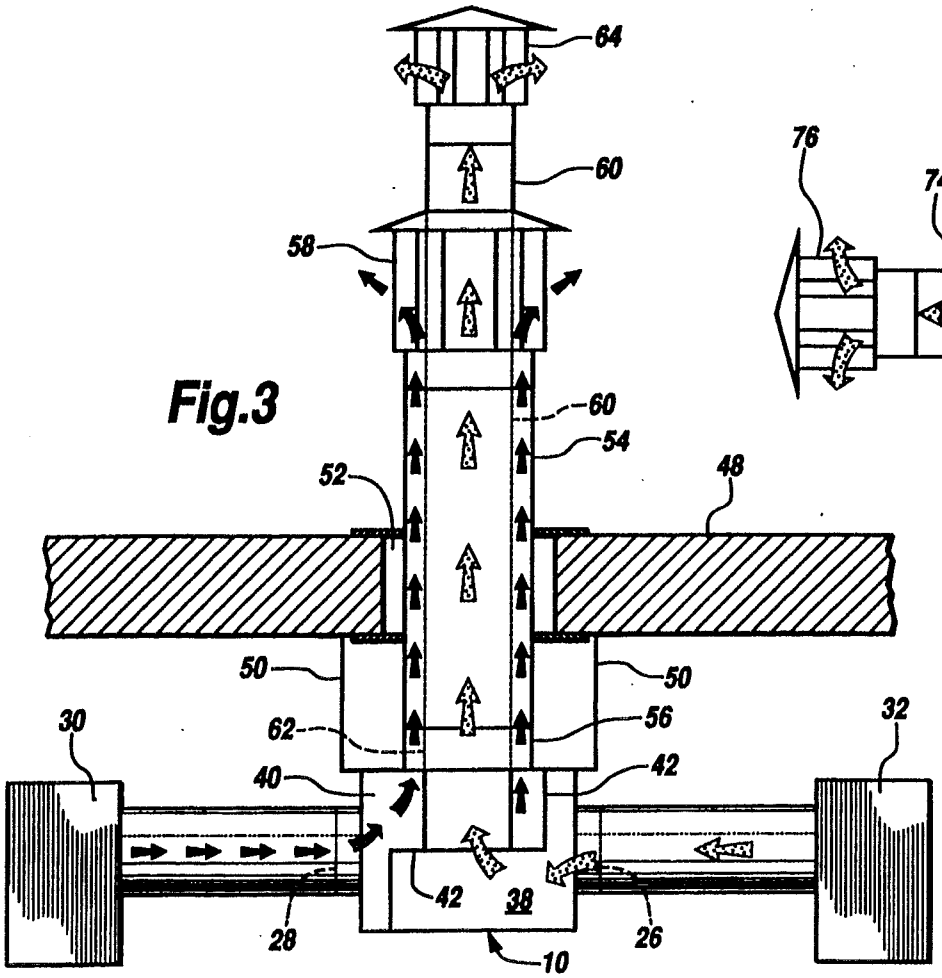
FIG. 3 is a schematic diagram showing the present invention installed in a vertically vented heating system, wherein exhaust gases are vented through a ceiling.

Referring now to FIG. 3, it is seen that adapter 10 may be secured to a representative ceiling 48 by means of straps 50 or other conventional mounting means. Ceiling 48 has a single opening 52 formed therein, through which exhaust vent pipe 54 extends. The proximate end 56 of vent pipe 54 is secured to pipe 36, and is therefore operative to channel combustion gases from heating unit 30 through chamber 40 outward through exhaust outlet 34. Exhaust gases from heating unit 30 are ultimately discharged to the outdoors through vent cap 58.

Concentrically contained within vent pipe 54 is a second exhaust vent pipe 60, having a proximate end 62 secured to pipe 46. Vent pipe 60 is therefore operative to channel exhaust gases generated by heating unit 32 from chamber 38 outwardly through outlet 44 and vent pipe 46. Exhaust gases from heating unit 32 are ultimately discharged to the outdoors through vent cap 64.

Figure 4:
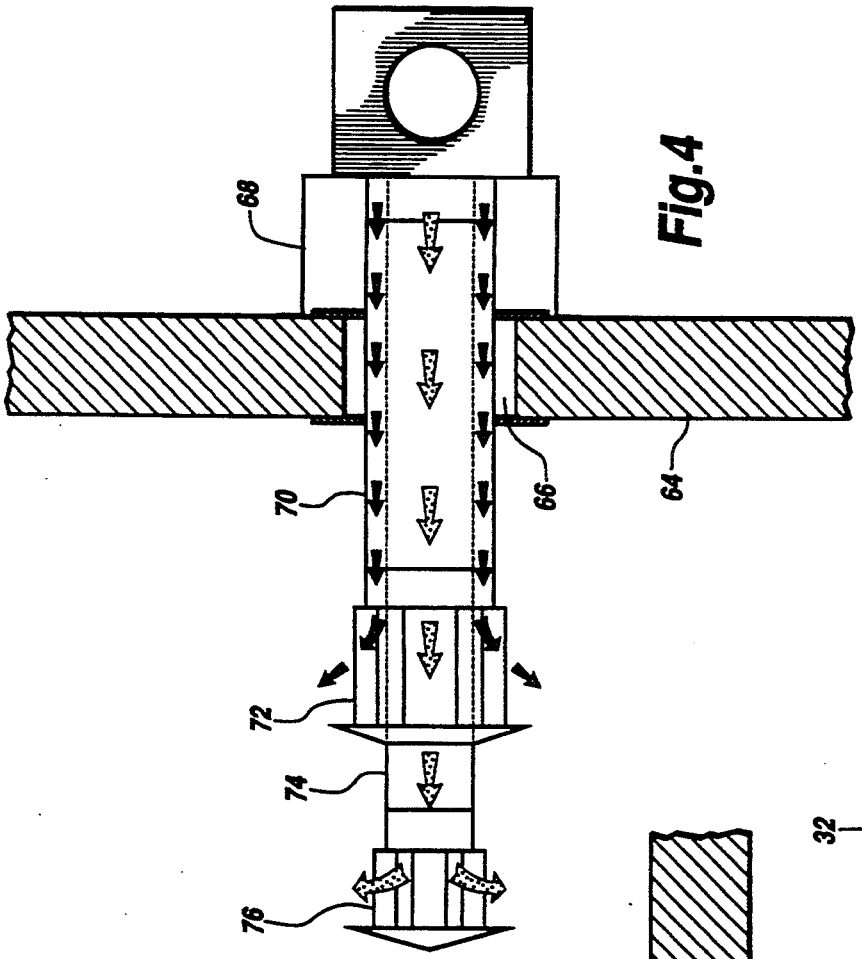
FIG. 4 is a schematic diagram of the present invention installed in a horizontally vented system, wherein exhaust gases are vented through a wall.

As shown in FIG. 4, adapter 10 is also well-suited to discharge exhaust gases from a pair of heating units (not shown in FIG. 4) through a wall 64 having a single opening 66 formed there through. In this configuration, adapter 10 is rigidly secured to wall 64 by mounting bracket 68 or other suitable means. Adapter 10 may also be suspended from a ceiling, in the manner shown generally in FIG. 3, yet oriented to exhaust combustion gases horizontally through a wall 64. When oriented horizontally as shown in FIG. 4, adapter 10 operates in the same manner described above, wherein the exhaust gases from one heating unit are channeled through a first exhaust vent pipe 70 and vent cap 72, while combustion gases from a second heating unit are discharged through a second vent pipe 74 and vent cap 76. Those skilled in the art will recognize that vent pipes 54 and 70 are essentially identical components, as are vent pipes 74 and 60, vent caps 72 and 58, and vent caps 76 and 64.

As made evident by this detailed description and the attached drawings, adapter 10 uniquely provides discrete chambers 38 and 40 which independently communicate with vent pipes 56 and 60, respectively, through outlets 44 and 34, thereby creating completely separate flow paths for combustion gases generated by heating units 30 and 32. Those skilled in the art will readily appreciate the advantages provided by such construction for adapter 10, particularly when heating units 30 and 32 utilize forced draft ventilation and operate on different cycles and at different heating levels. Independent flow paths eliminate the problems associated with inadvertent back flow of combustion gases into the exhaust outlet of a heating unit. This feature is especially useful when forced draft heating units are utilized with a horizontal exhaust system as shown in FIG. 4.

In the preferred embodiment of adapter 10 shown and described herein, divider 42 separates the interior of housing 12 into two chambers 38 and 40 to enable adapter 10 to accommodate two heating units 30 and 320 It is contemplated that, under certain circumstances, it may be desirable to construct adapter 10 to accommodate more than two heating units. It is to be expected that one skilled in the art could, after having reviewed this disclosure, make such modifications. Accordingly, the scope of this invention is not to be limited by the number of heating units involved.

While the principles of providing an adapter for independently venting a plurality of heating units through a single opening have been made clear, it will be appreciated that additional modifications are contemplated and may be realized by those skilled in the art. Accordingly, the scope of this invention is only to be limited by the appended claims.

What is claimed is:

1. An exhaust vent adapter for use with a plurality of vented heating devices, comprising:

a body having a plurality of inlets formed therein, one said inlet for each said heating device, said body further having a single exhaust opening formed therein;

a plurality of discrete chambers within said body, equal in number to said inlets and communicating therewith, each said chamber communicating with only one said inlet;

a plurality of concentric exhaust outlets, equal in number to said chambers and communicating therewith, each said exhaust outlet communicating with only one said chamber, wherein said exhaust outlets extend outwardly from said body through said single exhaust opening.

2. An exhaust vent adapter as set forth in claim 1, wherein the number of said inlets, said chambers, and said exhaust outlets is two each.

3. An exhaust vent adapter as set forth in claim 2, wherein:

said body comprises a box-like housing, having four generally rectangular walls bounded by a top and a bottom, with first and second inlets disposed in two of said walls;

said exhaust opening is formed in said top, a first exhaust outlet being defined by an external pipe attached to said top and annularly disposed about said exhaust opening;

first and second discrete chambers are defined by an internal divider disposed within said box-like housing, said divider having a hole formed therethrough, a second exhaust outlet being defined by an internal pipe attached to said divider and annularly disposed about said hole, said internal pipe extending through said exhaust hole concentrically within said external pipe, wherein said divider is operative to allow communication between said first inlet and said first exhaust outlet, and between said second inlet and said second exhaust outlet, while isolating said first inlet and said first exhaust outlet from said second inlet and said second exhaust outlet.

4. An exhaust vent adapter for use with at least two fuel burning heating units disposed within a building, each heating unit having a forced air exhaust duct for venting combustion gasses to the outdoors, said adapter enabling the heating units to vent said combustion gasses through a common exhaust vent in said building, said adapter comprising:

a body having at least two inlets formed therein, with a separate one of said inlets communicating with each said exhaust duct, said body further having an exhaust opening formed therein in communication with the outdoors through said exhaust vent in said building;

at least two discrete chambers disposed within said body, equal in number to said inlets and communicating therewith, each said chamber communicating with only one said inlet;

at least two concentric exhaust outlets, equal in number to said chambers and communicating therewith, each said exhaust outlet providing communication between one of said chambers and the outdoors through said exhaust opening.

5. An exhaust vent adapter as set forth in claim 4, wherein the number of said heating units, said inlets, said chambers, and said exhaust outlets is two each.

6. An exhaust vent adapter as set forth in claim 5, wherein:

said body comprises a box-like housing, having four generally rectangular walls bounded by a top and a bottom, with first and second inlets disposed in two of said walls;

said exhaust opening is formed in said top, a first exhaust outlet being defined by an external pipe attached to said top and annularly disposed about said exhaust opening;

first and second discrete chambers are defined by an internal divider disposed within said box-like housing, said divider having a hole formed therethrough, a second exhaust outlet being defined by an internal pipe attached to said divider and annularly disposed about said hole, said internal pipe extending through said exhaust hole concentrically within said external pipe, wherein said divider is operative to allow communication between said first inlet and said first exhaust outlet, and between said second inlet and said second exhaust outlet, while isolating said first inlet and said first exhaust outlet from said second inlet and said second exhaust outlet.

* * * * *